US010299578B2

(12) United States Patent
Wu et al.

(10) Patent No.: US 10,299,578 B2
(45) Date of Patent: May 28, 2019

(54) ORAL CARE IMPLEMENT

(71) Applicant: COLGATE-PALMOLIVE COMPANY, New York, NY (US)

(72) Inventors: Donghui Wu, Bridgewater, NJ (US); Alan Sorrentino, Cranbury, NJ (US); Robert Moskovich, East Brunswick, NJ (US); Eduardo Jimenez, Manalapan, NJ (US); Kenneth Waguespack, North Brunswick, NJ (US); Douglas Joseph Hohlbein, Hopewell, NJ (US); Matthew Lee Kolb, Upper Black Eddy, PA (US); Paul Donald Carse, Milford, NJ (US)

(73) Assignee: Colgate-Palmolive Company, New York, NY (US)

( * ) Notice: Subject to any disclaimer, the term of this patent is extended or adjusted under 35 U.S.C. 154(b) by 93 days.

(21) Appl. No.: 15/309,192

(22) PCT Filed: May 7, 2014

(86) PCT No.: PCT/US2014/037146
§ 371 (c)(1),
(2) Date: Nov. 6, 2016

(87) PCT Pub. No.: WO2015/171132
PCT Pub. Date: Nov. 12, 2015

(65) Prior Publication Data

US 2017/0071325 A1 Mar. 16, 2017

(51) Int. Cl.
*A46B 5/00* (2006.01)
*A46B 5/02* (2006.01)
(Continued)

(52) U.S. Cl.
CPC ..... *A46B 11/0006* (2013.01); *A46B 5/0095* (2013.01); *A46B 5/021* (2013.01);
(Continued)

(58) Field of Classification Search
CPC ..... A46B 5/0012; A46B 11/0017; A46B 11/0079; A46B 11/0086
See application file for complete search history.

(56) References Cited

U.S. PATENT DOCUMENTS 2,743,042 A 6/1953 Burgin
2,652,949 A 9/1953 Martin
(Continued)

FOREIGN PATENT DOCUMENTS

CN 201861072 U 6/2011
CN 202146044 U 2/2012
(Continued)

OTHER PUBLICATIONS

International Search Report and the Written Opinion of the International Searching Authority issued in international application PCT/US2014/037146 dated Jan. 22, 2015.

*Primary Examiner* — David P Angwin
*Assistant Examiner* — Bradley S Oliver

(57) ABSTRACT

Disclosed is an oral care implement, comprising: a body comprising a handle and a head at an end of the handle; the body having a cavity therein for storing an oral care fluid; the head having at least one oral care element extending therefrom, and a fluid outlet through which the oral care fluid is dispensable to an exterior of the oral care implement; a passageway fluidly connecting the cavity with the fluid outlet; a mechanism for introducing air into the cavity from the exterior of the oral care implement; and a control valve on the head movable relative to the head between a first position for preventing fluid flow from the cavity through
(Continued)

the fluid outlet and a second position for permitting fluid flow from the cavity through the fluid outlet.

16 Claims, 7 Drawing Sheets

(51) Int. Cl.
*A46B 9/04* (2006.01)
*A46B 11/00* (2006.01)

(52) U.S. Cl.
CPC ..... *A46B 5/026* (2013.01); *A46B 9/04* (2013.01); *A46B 11/002* (2013.01); *A46B 11/0041* (2013.01); *A46B 11/0058* (2013.01); *A46B 11/0086* (2013.01); *A46B 2200/1066* (2013.01)

(56) References Cited

U.S. PATENT DOCUMENTS 3,256,894 A * 6/1966 Sherman ..... A46B 11/0055 401/188 R
3,400,996 A 9/1968 Vandergrift
4,124,316 A * 11/1978 O'Rourke ..... A46B 11/0041 401/184
4,155,663 A 5/1979 Cerquozzi
4,521,128 A 6/1985 O'Neal
4,582,075 A 4/1986 O'Neal
4,615,635 A * 10/1986 Kim ..... A46B 11/0079 401/134
4,963,046 A 10/1990 Eguchi
5,393,153 A 2/1995 Bouthillier
5,407,287 A * 4/1995 Braun ..... A46B 11/0017 401/176
5,918,995 A 7/1999 Puurunen
6,206,600 B1 3/2001 Rosenberg et al.
7,021,851 B1 * 4/2006 King ..... A46B 11/0079 401/186
7,757,330 B2 7/2010 Hegemann et al.
2003/0198503 A1 * 10/2003 Gordon ..... A46B 11/0017 401/278
2006/0115317 A1 * 6/2006 Johns ..... A46B 11/0079 401/181
2007/0041779 A1 2/2007 Kuo
2007/0086831 A1 4/2007 Wold
2012/0301209 A1 * 11/2012 Fattori ..... A46B 11/0041 401/171
2013/0308994 A1 11/2013 Wu
2017/0318953 A1 * 11/2017 Park ..... A46B 11/0055

FOREIGN PATENT DOCUMENTS

DE 202004008909 9/2004
FR 2600513 12/1987
GB 913371 12/1962
GB 2290702 1/1996
GB 2291799 2/1996
GB 2329110 3/1999

* cited by examiner

ORAL CARE IMPLEMENT

BACKGROUND

The present invention relates to an oral care implement, such as a toothbrush, having an oral care fluid dispensing mechanism.

It is known to provide an oral care implement, such as a toothbrush, with a reservoir storing an oral care fluid that is feedable to a fluid outlet at a head of the implement. One such known oral care implement has a pump mechanism for dispensing the oral care fluid that requires repeated actuation during dispensing in order to dispense a volume of the oral care fluid sufficient for the user to benefit from the effects of the oral care fluid. Since the dispensing is carried out while the oral care implement is held aloft with the fluid outlet within the user's oral cavity, such repeated actuation of the pump mechanism during dispensing is inconvenient, and can be tiresome and uncomfortable for the user.

There is a need for an oral care implement having an oral care fluid dispensing mechanism that is convenient to use and that is less tiresome and uncomfortable to operate during dispensing.

BRIEF SUMMARY

An embodiment of the present invention provides a first oral care implement, comprising: a body comprising a handle and a head at an end of the handle; the body having a cavity therein for storing an oral care fluid; the head having at least one oral care element extending therefrom, and a fluid outlet through which the oral care fluid is dispensable to an exterior of the oral care implement; a passageway fluidly connecting the cavity with the fluid outlet; a mechanism for introducing air into the cavity from the exterior of the oral care implement; and a control valve on the head movable relative to the head between a first position for preventing fluid flow from the cavity through the fluid outlet and a second position for permitting fluid flow from the cavity through the fluid outlet.

Optionally, the oral care implement comprises a movable wall in the cavity, the wall dividing the cavity into first and second reservoirs of variable volume, wherein the first reservoir is for storing the oral care fluid, and wherein the passageway fluidly connects the first reservoir with the fluid outlet.

Optionally, the body further defines a first opening fluidly connecting the second reservoir with the exterior of the oral care implement. Further optionally, the oral care implement comprises a first check valve for permitting air flow into the second reservoir from the exterior of the oral care implement via the first opening and for restricting air flow from the second reservoir to the exterior of the oral care implement via the first opening.

Optionally, the wall comprises a piston.

Optionally, the wall comprises a deformable vessel surrounding the first reservoir, wherein the vessel has an orifice in fluid communication with the passageway.

Optionally, the vessel is deformable according to a predetermined pattern of collapse. Optionally, the vessel comprises a bellows.

Optionally, at least a portion of the second reservoir surrounds the first reservoir.

Optionally, the oral care implement comprises a pump comprising a chamber and a second opening fluidly connecting the chamber with the exterior of the oral care implement, wherein the chamber is fluidly connected with the second reservoir via the first opening.

Optionally, the chamber is of variable volume, and the pump is operable to reduce the volume of the chamber when the second opening is blocked, thereby to push air from the chamber into the second reservoir via the first opening. Further optionally, the pump comprises flexible material defining the chamber.

Optionally, the pump comprises a second check valve for permitting air flow into the chamber from the exterior of the oral care implement via the second opening and for restricting air flow from the chamber to the exterior of the oral care implement via the second opening.

Optionally, the pump is at an opposite end of the handle from the head.

Optionally, the cavity is in the handle.

Optionally, the cavity is of fixed volume. Alternatively, the cavity is of variable volume. The handle may define the cavity and be compressible to reduce the volume of the cavity.

Optionally, the oral care implement comprises a third check valve for permitting flow from the cavity through the fluid outlet and for restricting flow through the fluid outlet towards the cavity.

Optionally, the passageway comprises a dip tube in the cavity.

Optionally, when the control valve is at the first position, the control valve blocks the fluid outlet.

Optionally, when the control valve is at the first position, the control valve blocks the passageway.

Optionally, the oral care implement comprises a biasing device that biases the control valve to the first position.

Optionally, the oral care fluid is stored in the cavity.

Optionally, the oral care fluid comprises one or more oral care agents selected from the group consisting of: antibacterial agents; oxidative or whitening agents; enamel strengthening or repair agents; tooth erosion preventing agents; tooth anti-sensitivity ingredients; gum health actives; nutritional ingredients; tartar control or anti-stain ingredients; enzymes; sensate ingredients; caries or plaque disclosing agents; flavors or flavor ingredients; breath freshening ingredients; oral malodor reducing agents; anti-attachment agents or sealants; diagnostic solutions; occluding agents, dry mouth relief ingredients; catalysts to enhance the activity of any of these agents; colorants or aesthetic ingredients; and combinations thereof.

Optionally, the oral care fluid is stored in the cavity with a propellant.

Optionally, the propellant comprises a liquefied gas; optionally wherein the liquefied gas comprises one or more of propane, butane, isobutene, dimethyl ether, and a hydroflurocarbon, or a mixture of any two or more thereof.

Optionally, the propellant comprises a compressed gas; optionally wherein the compressed gas comprises one or more of nitrogen, carbon dioxide, nitrous oxide, and compressed air, or a mixture of any two or more thereof.

Optionally, the oral care implement comprises a toothbrush.

Optionally, the head is a first head, and the control valve comprises a second head movably connected to the first head and having at least one oral care element extending therefrom, wherein the second head is movable relative to the first head between a first position for preventing fluid flow through the fluid outlet and a second position for permitting fluid flow through the fluid outlet.

Optionally, the head has at least one wall defining the fluid outlet, and the control valve comprises a deformable member extending through the fluid outlet, wherein the control valve is movable relative to the head between a first position for preventing fluid flow through the fluid outlet and a second position for permitting fluid flow through the fluid outlet between the deformable member and the wall.

Another embodiment of the present invention provides a second oral care implement, comprising: a body comprising a handle and a head at an end of the handle; the body having a cavity therein for storing an oral care fluid; the head having at least one oral care element extending therefrom, and at least one wall defining a fluid outlet through which the oral care fluid is dispensable to an exterior of the oral care implement; a passageway fluidly connecting the cavity with the fluid outlet; and a control valve comprising a deformable member extending through the fluid outlet, wherein the control valve is movable relative to the head between a first position for preventing fluid flow through the fluid outlet and a second position for permitting fluid flow through the fluid outlet between the deformable member and the wall.

Optionally, in either of the first and second oral care implements, a proximal end of the deformable member is anchored in the head.

Optionally, in either of the first and second oral care implements, the deformable member comprises a deformable finger.

Optionally, in either of the first and second oral care implements, the control valve comprises a flange extending around at least a portion of a perimeter or circumference of the deformable member. Further optionally, the flange blocks the fluid outlet when the control valve is at the first position; optionally wherein the flange is in contact with a side of the head in which the fluid outlet is formed when the control valve is at the first position.

Optionally, in either of the first and second oral care implements, the deformable member comprises a tooth cleaning or polishing element.

Optionally, in either of the first and second oral care implements, the deformable member is resilient.

A further embodiment of the present invention provides a third oral care implement, comprising: a body comprising a handle and a first head at an end of the handle; the body having a cavity therein for storing an oral care fluid; the first head having at least one oral care element extending therefrom, and a fluid outlet through which the oral care fluid is dispensable to an exterior of the oral care implement; a passageway fluidly connecting the cavity with the fluid outlet; and a control valve comprising a second head movably connected to the first head and having at least one oral care element extending therefrom, wherein the second head is movable relative to the first head between a first position for preventing fluid flow through the fluid outlet and a second position for permitting fluid flow through the fluid outlet.

Optionally, in either of the first and third oral care implements, the first and second heads are connected to each other by a hinge, such as a living hinge.

Optionally, in either of the first and third oral care implements, the oral care elements extend from respective first sides of the first and second heads, and the oral care implement comprises a flexible pad connecting respective second sides of the first and second heads, wherein the second sides of the heads are opposite from the first sides of the heads.

Optionally, in either of the first and third oral care implements, the flexible pad is comprised in a soft tissue cleaner of the oral care implement. Further optionally, the soft tissue cleaner comprises one or more projections extending from the flexible pad.

Optionally, in either of the first and third oral care implements, the second head comprises a stopper that is located in the fluid outlet when the second head is at the first position; optionally wherein the stopper is a resilient stopper.

Further areas of applicability of the present invention will become apparent from the detailed description provided hereinafter. It should be understood that the detailed description and specific examples, while indicating the preferred embodiment of the invention, are intended for purposes of illustration only and are not intended to limit the scope of the invention.

BRIEF DESCRIPTION OF THE DRAWINGS

The present invention will become more fully understood from the detailed description and the accompanying drawings, wherein.

DETAILED DESCRIPTION

The following description of the preferred embodiment(s) is merely exemplary in nature and is in no way intended to limit the invention, its application, or uses.

As used throughout, ranges are used as shorthand for describing each and every value that is within the range. Any value within the range can be selected as the terminus of the range. In addition, all references cited herein are hereby incorporated by referenced in their entireties. In the event of a conflict in a definition in the present disclosure and that of a cited reference, the present disclosure controls.

In the following description, each of the exemplary embodiments of the oral care implement of the invention comprises a manually-operated oral care implement, more specifically a manually-operated toothbrush. However, in variations to these embodiments, the oral care implement could instead comprise a powered oral care implement, such as a powered toothbrush, wherein one or more oral care elements provided to the head of the implement are drivable so as to be moved relative to the handle of the implement. In still further embodiments, the oral care implement could instead comprise other forms of oral care implement, such as a soft-tissue cleaner, a tooth polisher, an interdental brush, a tongue scraper, or another implement designed for oral care. It is to be understood that other embodiments may be utilised, and that structural and functional modifications may be made without departing from the scope of the present invention.

Figure 1:
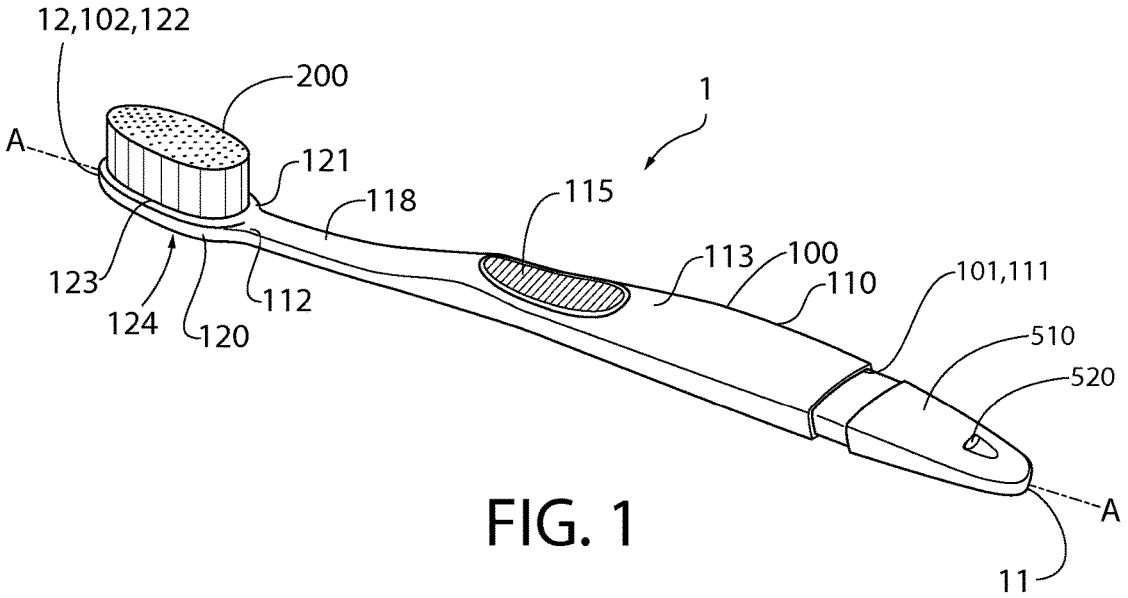
FIG. 1 shows a perspective view of an oral care implement according to an exemplary embodiment of the present invention.
Figure 2:
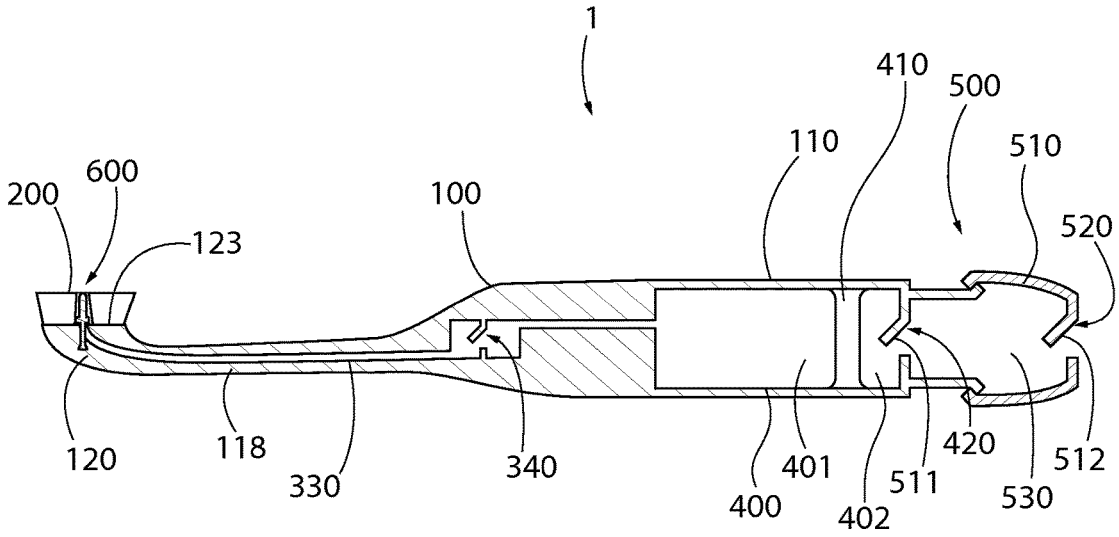
FIG. 2 shows a schematic diagram of the oral care implement of FIG. 1.

FIGS. 1 and 2 illustrate an oral care implement, in this case a toothbrush, according to an exemplary embodiment of the present invention, generally designated with the reference numeral 1. The toothbrush 1 has a proximal end 11 and a distal end 12 and is elongate between the proximal and distal ends 11, 12. The toothbrush 1 has a longitudinal axis A-A that extends approximately through each of the proximal and distal ends 11, 12 of the toothbrush 1. Moreover, the body 100 of the toothbrush 1 has a proximal end 101 and a distal end 102 and is elongate between the proximal and distal ends 101, 102 of the body 100. The body 100 comprises the handle 110 and the head 120 at a distal end 112 of the handle 110. The head 120 is a distal portion of the body 100 and has a proximal end 121 and a distal end 122, which distal end 122 forms the distal end 102 of the body 100 and the distal end 12 of the toothbrush 1. The head 120 has extending therefrom the oral care elements 200 for cleaning or polishing surfaces in a user's mouth, such as surfaces of their teeth.

The oral care elements 200 extend from a first, front side of the toothbrush 1, more specifically from a first, front side 123 of the head 120, and are for cleaning or polishing surfaces in a user's mouth, such as surfaces of their teeth. As used herein, the term "oral care element" is used in a generic sense to refer to any structure that can be used to clean, massage or polish an oral surface, such as teeth or soft tissue, through relative surface contact. In this embodiment, the oral care elements comprise a plurality of tooth cleaning elements, preferably a plurality of flexible bristles arranged in tufts. However, in variations to this embodiment, the oral care elements may additionally or alternatively comprise one or more tooth polishing elements, preferably in the form of elastomeric tooth polishing elements, such as elastomeric protrusions, elements, fingers, or prophylactic (prophy) cups. In some embodiments, the oral care elements 200 may comprise at least one of any one or more of the following, without limitation: bristles, rigid bristles, flexible bristles, filament bristles, fibre bristles, nylon bristles, polybutylene terephthalate (PBT) bristles, tapered bristles, spiral bristles, rubber bristles, elastomeric protrusions, elastomeric elements, flexible polymer protrusions, co-extruded filaments, flag bristles, crimped bristles, anti-bacterial bristles and combinations thereof and/or structures containing such materials or combinations. The head 120 also comprises or defines the fluid outlet 125 at the first, front side 123 of the head 120. The fluid outlet 125 will be described in more detail below.

In a variation to the illustrated embodiment, a soft tissue cleaner may be provided on a second side of the toothbrush 1, such as a second, rear side of the toothbrush 1 opposite to the front side of the toothbrush 1. Such a soft tissue cleaner may be provided on a second, rear side 124 of the head 120.

The handle 110 is a proximal portion of the body 100 and has the distal end 112 and the proximal end 111, which proximal end 111 forms the proximal end 101 of the body 100. The handle 110 includes a neck portion 118 by which the handle 110 is connected with the head 120. The neck portion 118 is generally of a smaller cross sectional area than the rest of the handle 110. The neck portion 118 includes the distal end 112 of the handle 110, which is that portion of the handle 110 fixed to and closest to the proximal end 121 of the head 120. In the illustrated embodiment, the head 120 is non-detachable from the handle 110. However, in variations to the illustrated embodiment, the head 120 may be detachable from the handle 110, such as for replacement of the head 110 when the oral care elements 200 become worn.

The handle 110 provides a user with a mechanism by which he/she can readily grip and manipulate the toothbrush 1, includes ergonomic features which provide a high degree of control for the user while maintaining comfort, and may be formed of many different shapes and with a variety of constructions. Although the handle 110 is a non-linear structure in the illustrated embodiment, the invention is not so limited, and in certain embodiments the toothbrush 1 may have a simple linear handle 110. In the illustrated embodiment, the toothbrush 1 comprises a thumb grip surface 115 on the first, front side of the toothbrush 1, more specifically on a first, front side 113 of the handle 110. On a second, rear side of the toothbrush 1, more specifically on a second, rear side of the handle 110, the toothbrush 1 may comprise a second grip surface. During use of the toothbrush 1, a user most comfortably holds the toothbrush 1 with the handle 110 lying in the palm of their hand, with their thumb on the thumb grip surface 115, and with their index and/or middle finger on the second grip surface.

As shown in FIG. 2, the toothbrush 1 comprises a cavity 400 in the handle 110 of the body 100. In the illustrated embodiment, the cavity 400 is comprised in a substantially rigid vessel formed from a plastic, such as a thermoplastic polymer, e.g. polyethylene terephthalate (PET) or polypropylene (PP), so that the cavity 400 is of substantially fixed volume. The cavity 400 is housed inside the body 100 of the toothbrush 1, and is not visible from the exterior of the toothbrush 1. However, in variations to the illustrated embodiment, the cavity 400 is comprised in a vessel made of transparent or translucent material and one or more windows are provided in the body 100, so that the cavity 400 and its contents are visible from the exterior of the toothbrush 1. In further embodiments, the vessel comprising the cavity 400 is comprised in the body 100, and the vessel comprising the cavity 400 forms at least part of the handle 110. In some embodiments, the vessel comprising the cavity 400 is comprised in the body 100, and the vessel comprising the cavity 400 forms the handle 110. In some embodiments, the vessel comprising the cavity 400 is detachably connected to the body 100 and may be replaceable or disposable.

Inside the cavity 400 is a movable wall in the form of a piston 410, which divides the cavity 400 into first and second reservoirs 401, 402 of variable volume. That is, the piston 401 isolates the first reservoir 401 from the second reservoir 402. The first reservoir 401 stores an oral care fluid, and the second reservoir 402 is for pre-pressurizing the oral care fluid in the first reservoir 401, as will be described below.

Preferably, the oral care fluid comprises one or more oral care agents. Any suitable oral care agent(s) can be used in the present invention. In the illustrated embodiment, the oral care fluid is a mouthwash comprising one or more antibacterial agents, flavors or flavor ingredients, and breath freshening ingredients. However, in variations to the illustrated embodiment, the oral care fluid comprises one or more oral care agents selected from the group consisting of: antibacterial agents; oxidative or whitening agents; enamel strengthening or repair agents; tooth erosion preventing agents; tooth anti-sensitivity ingredients; gum health actives; nutritional ingredients; tartar control or anti-stain ingredients; enzymes; sensate ingredients; caries or plaque disclosing agents; flavors or flavor ingredients; breath freshening ingredients; oral malodor reducing agents; anti-attachment agents or sealants; diagnostic solutions; occluding agents, dry mouth relief ingredients; catalysts to enhance the activity of any of these agents; colorants or aesthetic ingredients; and combinations thereof. In some embodiments, the oral care fluid comprises more than one of the oral care agents listed in the preceding sentence. The oral care fluid preferably is free of (i.e., is not) toothpaste. Preferably, the oral care fluid is intended to provide supplemental oral care benefits in addition to merely brushing one's teeth. The oral care fluid may be for enhancing the performance of dentifrice, to provide synergistic benefits.

With continuing reference to FIG. 2, the fluid outlet 125 is an outlet through which the oral care fluid is dispensable to an exterior of the toothbrush 1. The cavity 400, and more specifically the first reservoir 401, is fluidly connected to the fluid outlet 125 by a passageway 330. Thus, the passageway 330 extends from the cavity 400 in the handle 110, through the neck portion 118 of the handle 110, to the fluid outlet 125 of the head 120. In the illustrated embodiment, the passageway 330 is defined by material of the body 100. In variations to the illustrated embodiment, some or a majority of the passageway 330 may be defined by a separate, preferably flexible, tube that extends through the body 100.

Between the cavity 400 and the fluid outlet 125, the toothbrush 1 comprises a check valve 340 (herein referred to as the "third check valve", for ease of reference only) in the passageway 330 for permitting fluid flow from the first reservoir 401 towards the fluid outlet 125 and for restricting or preventing fluid flow from the fluid outlet 125 towards the first reservoir 401. The third check valve 340 helps avoid salvia and used dentifrice migrating from the oral care elements 200 to the first reservoir 401. In a variation to the illustrated embodiment, the third check valve 340 is omitted.

The head 120 further comprises a control valve 600 that is movable between a first position for preventing fluid flow from the cavity 400, and more specifically from the first reservoir 401, through the fluid outlet 125 and a second position for permitting fluid flow from the cavity 400, and more specifically from the first reservoir 401, through the fluid outlet 125. The control valve is best understood with reference to FIGS. 3 and 4.

The control valve 600 comprises a deformable member 610 that extends through the fluid outlet 125. In the illustrated embodiment, the flexible member 610 is flexible and resilient. The deformable member 610 may be formed of an elastomeric material, such as an elastomer, a thermoplastic elastomer (TPE), or styrene-ethylene/butylene-styrene (SEBS). In the illustrated embodiment, the deformable member 610 comprises a deformable finger 610 but, in variations to the illustrated embodiment, the deformable member may instead comprise a deformable panel or a deformable member of another shape. The deformable member 610 has a proximal end 612 anchored within the head 120 and a distal end 614 located between the oral care elements 200. In the illustrated embodiment, the distal end 614 of the deformable member 610 is at about the same height above the front side 123 of the head 120 as the oral care elements 200. In variations to the illustrated embodiment, the distal end 614 of the deformable member 610 may be at a lesser height above the front side 123 of the head 120 than some or all of the oral care elements 200, and/or the distal end 614 of the deformable member 610 may be at a greater height above the front side 123 of the head 120 than some or all of the oral care elements 200. The control valve 600 also comprises a flange 616 extending from the deformable member 610. In the illustrated embodiment, the flange 616 extends around the full perimeter or circumference of the deformable member 610, but in variations to the illustrated embodiment the flange 616 extends around only a portion of the perimeter or circumference of the deformable member 610.

Figure 3:
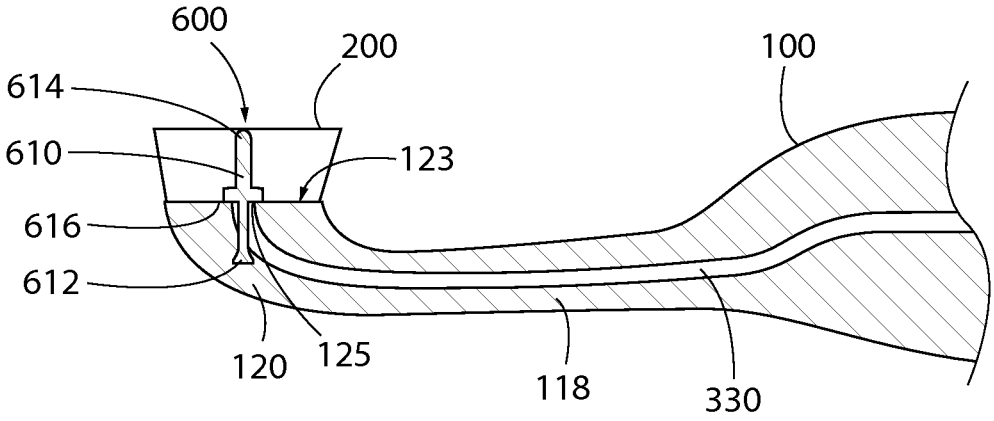
FIG. 3 shows a cross section of a head of the oral care implement of FIGS. 1 and 2, with a control valve of the head at a first position.

The presence of the deformable member 610 in the fluid outlet 125 does not itself block the fluid outlet 125 when the control valve 600 is at the first position, since there is space between the deformable member 610 and a wall of the head 120 that defines the fluid outlet 125. However, the flange 616 is in contact with the front side 123 of the head 120 and blocks the fluid outlet 125, as shown in FIG. 3, when the control valve 600 is at the first position. In some variations to the illustrated embodiment, such as that shown in FIGS. 5 and 6 or that shown in FIGS. 7 and 8, the flange 616 is omitted, and the deformable member 610 in the fluid outlet 125 itself blocks the fluid outlet 125 when the control valve 600 is at the first position.

During use of the toothbrush 1 in an oral care session, a force applied to the deformable member 610 by a surface in a user's oral cavity, such as their teeth or tongue, causes flexing, and thus deformation, of the deformable member 610 relative to the head 120 so that part of the flange 616 moves away from the front side 123 of the head 120 to place the passageway 330 in fluid communication with the exterior of the toothbrush 1. Such a force thus moves the control valve 600 to the second position for permitting fluid flow from the cavity 400, and more specifically from the first reservoir 401, through the fluid outlet 125 between the deformable member 610 and the wall of the head 120 defining the fluid outlet 125. Subsequent removal or reduction of the force permits the inherent resiliency of the material of the deformable member 610 to move the deformable member 610 back to the first position. In other words, the deformable member 610 is biased to the first position by the inherent resiliency of the material of the deformable member 610 itself.

At the proximal end 111 of the handle 110, and indeed the proximal end 101 of the body 100, the toothbrush 1 comprises the pump 500. The pump 500 is for pushing air into the second reservoir 402 from the exterior of the toothbrush 1. More specifically, the toothbrush 1 comprises a first opening 420 fluidly connecting the second reservoir 402 with the exterior of the toothbrush 1 via the pump 500. Since the overall cavity 400 is of a fixed volume, such pushing of air into the second reservoir 402 causes pressurization of the second reservoir 402 and, in turn, pressurization of the first reservoir 401 and the oral care fluid therein.

The pump 500 comprises a pump actuator 510 movably attached to the handle 110. The pump actuator 510 forms the proximal end 11 of the toothbrush 1. The handle 110 and the pump actuator 510 define therebetween a chamber 530 of the pump 500. Since the pump actuator 510 is movably attached to the handle 110, the chamber 530 is of variable volume. That is, as the pump actuator 510 is moved towards the handle 110, the volume of the chamber 530 is reduced. In a variation to the illustrated embodiment, the toothbrush 1 includes a biasing device, such as a helical spring, between the pump actuator 510 and the handle 110 for biasing the pump actuator 510 away from the handle 110.

In the illustrated embodiment, the pump actuator 510 is substantially rigid. In a variation to the illustrated embodiment, the pump actuator 510 comprises flexible material, such as an elastomer or an elastomeric material, defining the chamber 530. In such a variation, the volume of the chamber 530 is reducible by compressing or otherwise deforming the pump actuator 510.

The pump actuator 510 also defines a second opening 520 fluidly connecting the chamber 530 with the exterior of the toothbrush 1. The chamber 530 is fluidly connected with the second reservoir 402 via the first opening 420. Thus, the second reservoir 402 is fluidly connected with the exterior of the toothbrush 1 via the first opening 420, the chamber 530, and the second opening 520, in that order. The pump 500 further comprises a check valve 511 (herein referred to as the "first check valve", for ease of reference only) in the first opening 420 for permitting air flow into the second reservoir 402 from the exterior of the toothbrush 1 via the first opening 420 and for restricting or preventing air flow from the second reservoir 402 to the exterior of the toothbrush 1 via the first opening 420. In variations to the illustrated embodiment, the first check valve 511 may be fixed to an inner wall of the second reservoir 402, or to an inner wall of the chamber 530, over the first opening 420, and thus may not be considered to be in the first opening 420. The pump further comprises a check valve 512 (herein referred to as the "second check valve", for ease of reference only) in the second opening 520 for permitting air flow into the chamber 530 from the exterior of the toothbrush 1 via the second opening 520 and for restricting or preventing air flow from the chamber 530 to the exterior of the toothbrush 1 via the second opening 520. In variations to the illustrated embodiment, the second check valve 512 may be fixed to an outer wall of the pump actuator 510, or to an inner wall of the chamber 530, over the second opening 520, and thus may not be considered to be in the second opening 520. The pump 500 is operable to reduce the volume of the chamber 530 when the second opening 520 is blocked, e.g. by the second check valve 512, thereby to push air from the chamber 530 into the second reservoir 402 via the first opening 420.

Operation of the illustrated toothbrush 1 will now be described. While maintaining the control valve 600 at the first position, and preferably prior to brushing their teeth, a user moves the pump actuator 510 towards the handle 110, thereby to reduce the volume of the chamber 530. During this movement, the second check valve 512 prevents air leaving the chamber 530 via the second opening 520, and the first check valve 511 permits air to pass from the chamber 530 to the second reservoir 402 via the first opening 420, thereby increasing the pressure of air present in the second reservoir 402. The increased pressure of the air in the second reservoir 402 causes the air in the second reservoir 402 to apply a force to the piston 410. This application of force to the piston 410 causes the volume of the first reservoir 401 to be reduced, which pushes the oral care fluid in the first reservoir 401 towards the control valve 600. When the user subsequently moves the pump actuator 510 away from the handle 110, the chamber 530 expands, the second check valve 512 permits air to enter the chamber 530 via the second opening 520, and the first check valve 511 prevents air returning from the second reservoir 402 into the chamber 530 via the first opening 420. Repeated such movements of the pump actuator 510 towards, and then away from, the handle 110 while the control valve 600 is at the first position further increases the pressure of the oral care fluid in the first reservoir 401. That is, the oral care fluid in the first reservoir 401 becomes "pre-pressurized".

Preferably, the user next applies a dentifrice to the oral care elements 200 and then uses the dentifrice and the oral care elements 200 to brush their teeth. During the brushing, a force applied to the deformable member 610 of the control valve 600 by a surface in the user's oral cavity, such as their teeth or tongue, causes flexing, and thus deflection, of the deformable member 610 relative to the head 120, so that part of the flange 616 moves away from the front side 123 of the head 120 to place the passageway 330 in fluid communication with the exterior of the toothbrush 1. Such a force thus moves the control valve 600 to the second position for permitting fluid flow from the cavity 400, and more specifically from the first reservoir 401, through the fluid outlet 125 between the deformable member 610 and the wall of the head 120 defining the fluid outlet 125. Since the oral care fluid in the first reservoir 401 has been pre-pressurized, when the control valve 600 is moved to the second position, an appreciable volume of the oral care fluid flows out of the toothbrush 1 through the fluid outlet 125 via the passageway 330. The user may then remove or reduce the force applied to the deformable member 610, to permit the flange 616 to move back into full contact with the front side 123 of the head 120 to block the fluid outlet 125, thereby to return the control valve 600 to the first position. Of course, a user may choose to dispense the oral care fluid before, during or after brushing their teeth.

Figure 4:
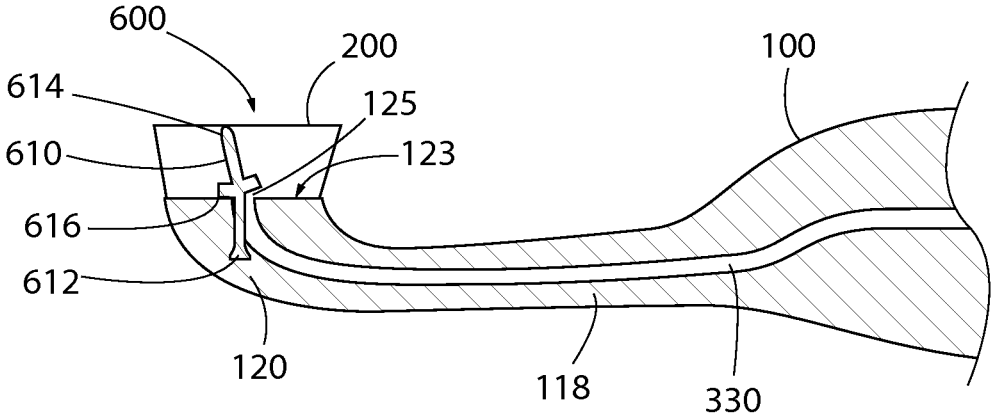
FIG. 4 shows a cross section of the head of the oral care implement of FIGS. 1 and 2, with the control valve at a second position.
Figure 5:
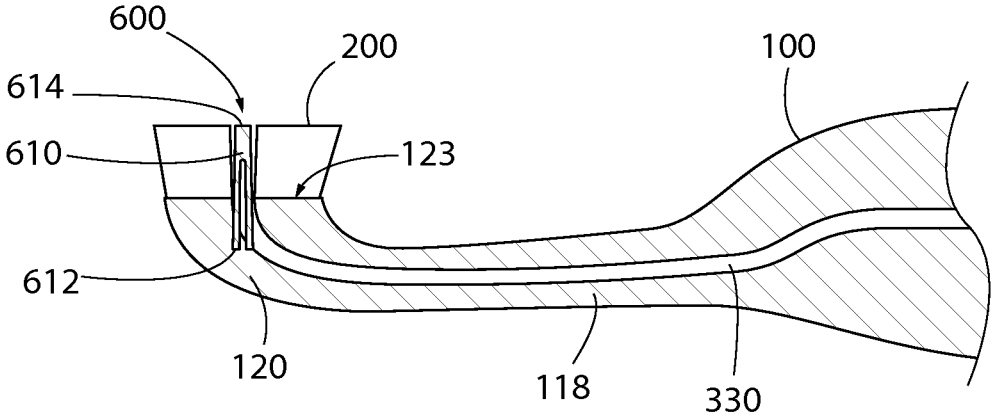
FIG. 5 shows a cross section of a head of an oral care implement according to another exemplary embodiment of the present invention, with a control valve of the head at a first position.
Figure 6:
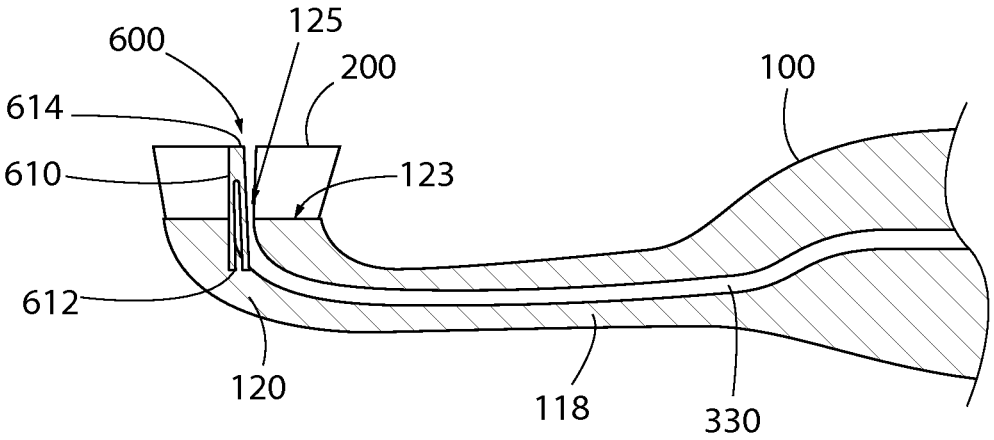
FIG. 6 shows a cross section of the head of the oral care implement of FIG. 5, with the control valve at a second position.

In a variation to control valve 600 of FIGS. 2 to 4, the oral care implement 1 of FIG. 1 could instead have a control valve like that shown in FIGS. 5 and 6. Other than for the form of the control valve, the oral care implement 1 of which a part is shown in FIGS. 5 and 6 is the same as the oral care implement 1 of FIGS. 1 to 4. Like reference numerals used in FIGS. 5 and 6 and FIGS. 1 to 4 indicate like components.

The control valve 600 of the toothbrush 1 of FIGS. 5 and 6 comprises a deformable member 610 that extends through the fluid outlet 125. In the illustrated embodiment, the flexible member 610 is flexible and resilient. The deformable member 610 may be formed of an elastomeric material, such as an elastomer, a thermoplastic elastomer (TPE), or styrene-ethylene/butylene-styrene (SEBS). In the illustrated embodiment, the deformable member 610 comprises a deformable finger 610 but, in variations to the illustrated embodiment, the deformable member may instead comprise a deformable panel or a deformable member of another shape. The deformable member 610 has a proximal end 612 anchored within the head 120 and a distal end 614 located between the oral care elements 200. In the illustrated embodiment, the distal end 614 of the deformable member 610 is at about the same height above the front side 123 of the head 120 as the oral care elements 200. In variations to the illustrated embodiment, the distal end 614 of the deformable member 610 may be at a lesser height above the front side 123 of the head 120 than some or all of the oral care elements 200, and/or the distal end 614 of the deformable member 610 may be at a greater height above the front side 123 of the head 120 than some or all of the oral care elements 200. The deformable member 610 has a hollow interior to permit collapse or compression of the deformable member 610. In variations to the illustrated embodiment, the deformable member 610 has a solid interior but is otherwise able to collapse or compress.

The deformable member 610 blocks the fluid outlet 125 when the control valve 600 is at the first position, as shown in FIG. 5. During use of the toothbrush 1 in an oral care session, a force applied to the deformable member 610 by a surface in a user's oral cavity, such as their teeth or tongue, causes flexing, and thus deformation, of the deformable member 610 relative to the head 120 so that the deformable member 610 becomes compressed or otherwise deflected from the wall of the head 120 defining the fluid outlet 125, thereby to place the passageway 330 in fluid communication with the exterior of the toothbrush 1. Such a force thus moves the control valve 600 to the second position for permitting fluid flow from the cavity 400, and more specifically from the first reservoir 401, through the fluid outlet 125 between the deformable member 610 and the wall of the head 120 defining the fluid outlet 125. Subsequent removal or reduction of the force permits the inherent resiliency of the material of the deformable member 610 to move the deformable member 610 back to the first position. In other words, the deformable member 610 is biased to the first position by the inherent resiliency of the material of the deformable member 610 itself.

From a user's perspective, the oral care implement 1 of FIGS. 5 and 6 is usable in the same way as the oral care implement 1 of FIGS. 1 to 4 to pre-pressurize the oral care fluid in the first reservoir 401, and to then dispense some of the oral care fluid into their oral cavity in order to benefit from the effects of the oral care fluid. Again, the user may choose to dispense the oral care fluid before, during or after brushing their teeth.

Figure 7:
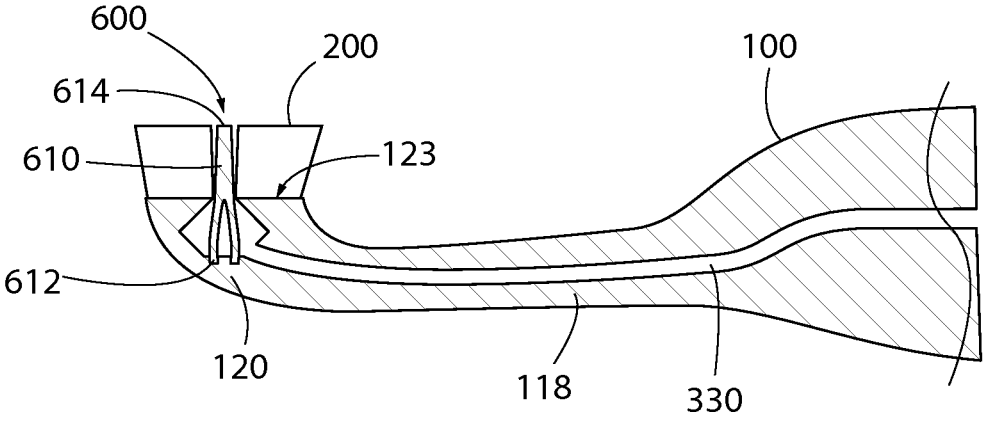
FIG. 7 shows a cross section of a head of an oral care implement according to a further exemplary embodiment of the present invention, with a control valve of the head at a first position.
Figure 8:
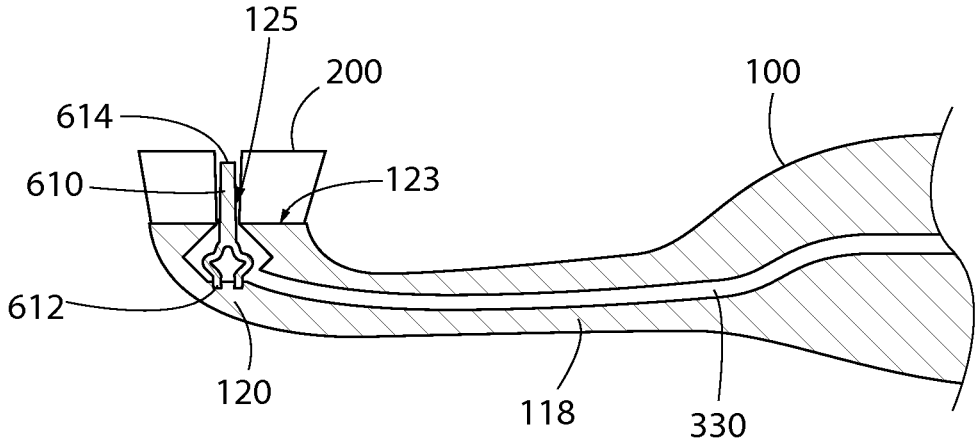
FIG. 8 shows a cross section of the head of the oral care implement of FIG. 7, with the control valve at a second position.

In another variation to control valve 600 of FIGS. 2 to 4, the oral care implement 1 of FIG. 1 could instead have a control valve like that shown in FIGS. 7 and 8. Other than for the form of the control valve, the oral care implement 1 of which a part is shown in FIGS. 7 and 8 is the same as the oral care implement 1 of FIGS. 1 to 4. Like reference numerals used in FIGS. 7 and 8 and FIGS. 1 to 4 indicate like components.

The control valve 600 of the toothbrush 1 of FIGS. 7 and 8 comprises a deformable member 610 that extends through the fluid outlet 125. In the illustrated embodiment, the flexible member 610 is flexible and resilient. The deformable member 610 may be formed of an elastomeric material, such as an elastomer, a thermoplastic elastomer (TPE), or styrene-ethylene/butylene-styrene (SEBS). In the illustrated embodiment, the deformable member 610 comprises a deformable finger 610 but, in variations to the illustrated embodiment, the deformable member may instead comprise a deformable panel or a deformable member of another shape. The deformable member 610 has a cone-shaped proximal end 612, with its widest part anchored within the head 120, and a distal end 614 located between the oral care elements 200. In the illustrated embodiment, the distal end 614 of the deformable member 610 is at about the same height above the front side 123 of the head 120 as the oral care elements 200 when the control valve 600 is at the first position, as shown in FIG. 7. In variations to the illustrated embodiment, the distal end 614 of the deformable member 610 may be at a lesser height above the front side 123 of the head 120 than some or all of the oral care elements 200, and/or the distal end 614 of the deformable member 610 may be at a greater height above the front side 123 of the head 120 than some or all of the oral care elements 200, when the control valve 600 is at the first position. The cone-shaped proximal end 612 of the deformable member 610 has a hollow interior to permit collapse or compression of the proximal end 612 of the deformable member 610.

In variations to the illustrated embodiment, the proximal end 612 of the deformable member 610 is not cone-shaped, but comprises a leg, or spaced apart legs, anchored within the head 120. Nevertheless, the proximal end 612 would be collapsible or compressible to permit the distal end 614 of the deformable member 610 to move towards the head 120.

The deformable member 610, or more specifically a portion of the proximal end 612 of the deformable member 610, blocks the fluid outlet 125 when the control valve 600 is at the first position, as shown in FIG. 7. During use of the toothbrush 1 in an oral care session, a force applied to the deformable member 610 by a surface in a user's oral cavity, such as their teeth or tongue, causes the distal end 614 of the deformable member 610 to be pushed towards the head 120, so that the proximal end 612 of the deformable member 610 becomes compressed or collapsed, thereby moving the portion of the proximal end 612 away from the wall of the head 120 defining the fluid outlet 125, so as to place the passageway 330 in fluid communication with the exterior of the toothbrush 1. Such a force thus moves the control valve 600 to the second position for permitting fluid flow from the cavity 400, and more specifically from the first reservoir 401, through the fluid outlet 125 between the deformable member 610 and the wall of the head 120 defining the fluid outlet 125. Subsequent removal or reduction of the force permits the inherent resiliency of the material of the deformable member 610 to move the deformable member 610 back to the first position. In other words, the deformable member 610 is biased to the first position by the inherent resiliency of the material of the deformable member 610 itself.

From a user's perspective, the oral care implement 1 of FIGS. 7 and 8 is usable in the same way as the oral care implement 1 of FIGS. 1 to 4 to pre-pressurize the oral care fluid in the first reservoir 401, and to then dispense some of the oral care fluid into their oral cavity in order to benefit from the effects of the oral care fluid. Again, the user may choose to dispense the oral care fluid before, during or after brushing their teeth.

Figure 9:
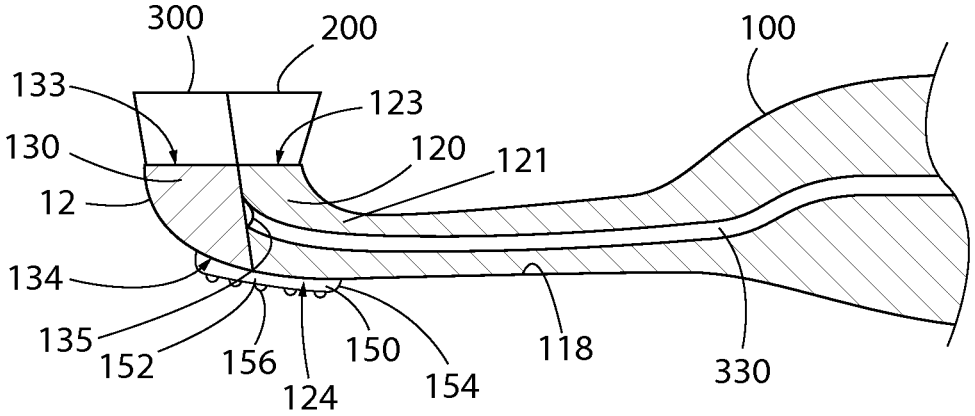
FIG. 9 shows a cross section of a head of an oral care implement according to a further exemplary embodiment of the present invention, with a control valve of the head at a first position.
Figure 10:
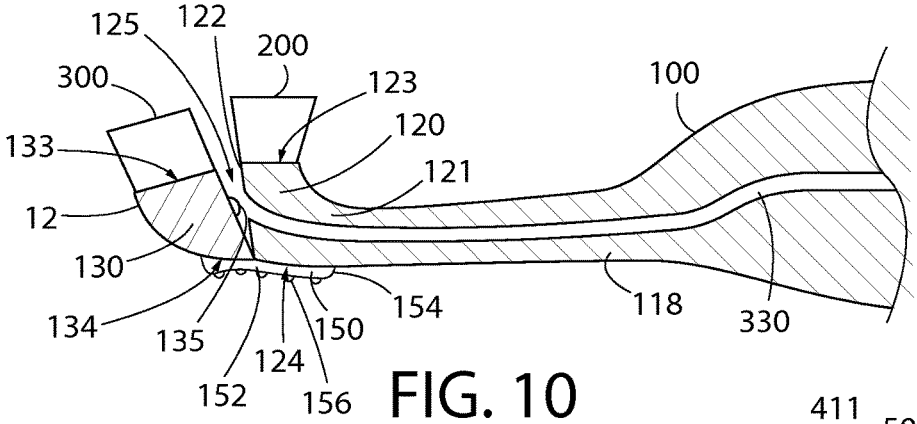
FIG. 10 shows a cross section of the head of the oral care implement of FIG. 9, with the control valve at a second position.

In a further variation to control valve 600 of FIGS. 2 to 4, the oral care implement 1 of FIG. 1 could instead have a control valve like that shown in FIGS. 9 and 10. Other than for the form of the control valve, the oral care implement 1 of which a part is shown in FIGS. 9 and 10 is the same as the oral care implement 1 of FIGS. 1 to 4. Like reference numerals used in FIGS. 9 and 10 and FIGS. 1 to 4 indicate like components.

As best shown in FIG. 10, the fluid outlet 125 of the toothbrush of FIGS. 9 and 10 is at the distal end 122 of the head 120 (herein referred to as the "first head", for ease of reference only). The control valve of the toothbrush of FIGS. 9 and 10 comprises a second head 130, which second head 130 is movably connected to the first head 120 at the distal end 122 of the first head 120 by a living hinge 152, has at least one oral care element 300 extending therefrom, and defines the distal end 12 of the toothbrush 1. The second head 130 is movable relative to the first head 120 between a first position for preventing fluid flow through the fluid outlet 125, as shown in FIG. 9, and a second position for permitting fluid flow through the fluid outlet 125, as shown in FIG. 10.

More specifically, the oral care elements 200, 300 extend from respective first sides 123, 133 of the first and second heads 120, 130, and the toothbrush has a flexible pad 154 connecting respective second sides 124, 134 of the first and second heads 120, 130, which second sides 124, 134 are opposite from the first sides 123, 133 of the heads 120, 130. The first sides 123, 133 of the heads 120, 130 are on the first, front side of the toothbrush, whereas the second sides 124, 134 of the heads 120, 130 are on the second, rear side of the toothbrush. The flexible pad 154 forms the living hinge 152 and may be formed of an elastomeric material, such as an elastomer, a thermoplastic elastomer (TPE), or styrene-ethylene/butylene-styrene (SEBS). The flexible pad 154 is comprised in a soft tissue cleaner 150 of the toothbrush, which soft tissue cleaner 150 also comprises a plurality of projections 156 extending from the flexible pad 154. In variations to the illustrated embodiment, the first and second heads 120, 130 are connected to each other by a non-living hinge or by some other mechanism that still permits the second head 130 to move relative to the first head 120 between the first and second positions for controlling fluid flow through the fluid outlet 125.

The second head 130 comprises a resilient stopper 135 that is located in the fluid outlet 125 when the second head 130 is at the first position, so as to positively seal the fluid outlet 125 when the second head 130 is at the first position. The stopper 135 may be integrally formed with the flexible pad 154. In variations to the illustrated embodiment, the stopper 135 may be non-resilient or even omitted.

The toothbrush of FIGS. 9 and 10 is usable in the same way as the oral care implement 1 of FIGS. 1 to 4 to pre-pressurize the oral care fluid in the first reservoir 401. Subsequently, during use of the toothbrush in an oral care session, a force applied to the second head 130 by a surface in a user's oral cavity, such as their teeth or tongue, causes flexing of the flexible pad 154, and thus deflection of the second head 130 relative to the first head 120, so that the stopper 135 is removed from the fluid outlet 125 to place the passageway 330 in fluid communication with the exterior of the toothbrush 1. Such a force thus moves the second head 130 to the second position for permitting fluid flow from the cavity 400, and more specifically from the first reservoir 401, through the fluid outlet 125 between the first and second heads 120, 130. Subsequent removal or reduction of the force permits the inherent resiliency of the material of the flexible pad 154 to move the second head 130 back to the first position. In other words, the second head 130 is biased to the first position by the resiliency of the material of the flexible pad 154.

Figure 11:
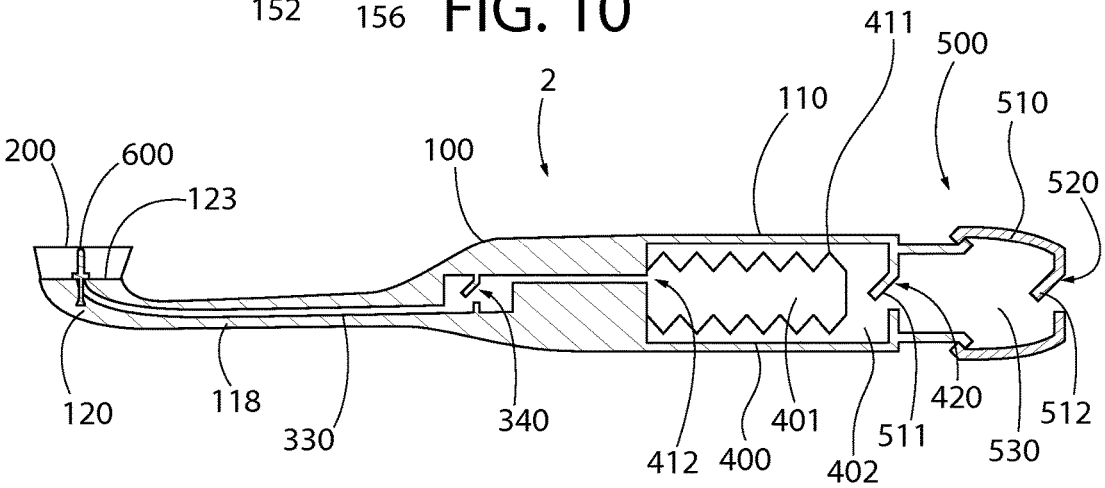
FIG. 11 shows a schematic diagram of an oral care implement according to a still further exemplary embodiment of the present invention.

FIG. 11 illustrates an oral care implement, in this case a toothbrush, according to another exemplary embodiment of the present invention, generally designated with the reference numeral 2. Like reference numerals used in FIG. 11 and FIG. 2 indicate like components. The oral care implement 2 of FIG. 11 shares many features with the oral care implement 1 of FIGS. 1 to 4, and differs only in the form of the movable wall in the cavity 400. The exterior of the oral care implement 2 of FIG. 11 is the same as that shown in FIG. 1.

In the oral care implement 2 of FIG. 11, the movable wall comprises a deformable vessel 411 surrounding the first reservoir 401, and the vessel 411 has an orifice 412 in fluid communication with the passageway 330. The vessel 411 is deformable according to a predetermined pattern of collapse and comprises a bellows. In a variation to the illustrated embodiment, the vessel 411 may be a bag or other vessel that is deformable according to an unpredictable pattern of collapse. As will be appreciated from FIG. 11, a portion of the second reservoir 402 surrounds the first reservoir 401.

From a user's perspective, the oral care implement 2 of FIG. 11 is usable in the same way as the oral care implement 1 of FIGS. 1 to 4 to pre-pressurize the oral care fluid in the first reservoir 401, and to then dispense some of the oral care fluid into their oral cavity in order to benefit from the effects of the oral care fluid. Again, the user may choose to dispense the oral care fluid before, during or after brushing their teeth.

Figure 12:
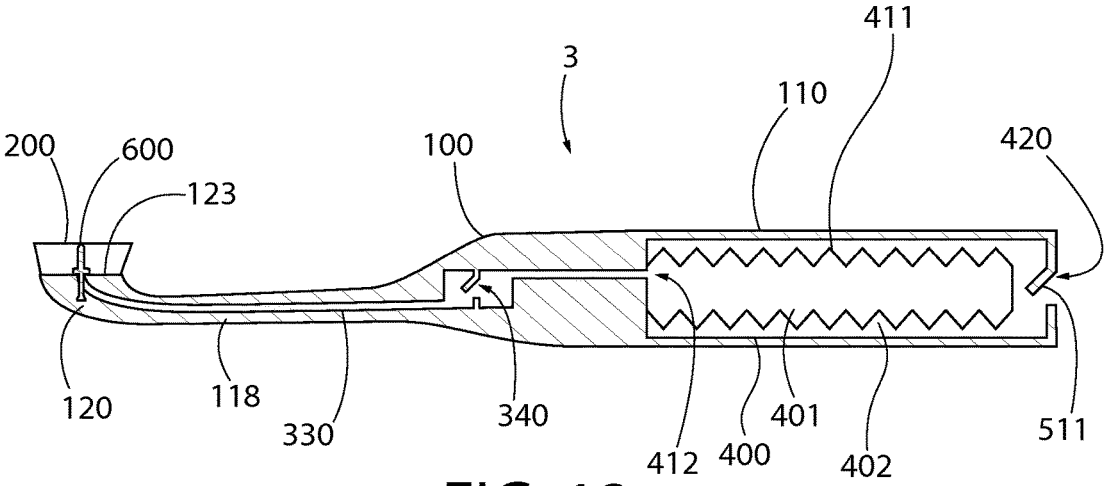
FIG. 12 shows a schematic diagram of an oral care implement according to a still further exemplary embodiment of the present invention.

FIG. 12 illustrates an oral care implement, in this case a toothbrush, according to a further exemplary embodiment of the present invention, generally designated with the reference numeral 3. Like reference numerals used in FIG. 12 and FIG. 11 indicate like components. The oral care implement 3 of FIG. 12 shares many features with the oral care implement 2 of FIG. 11. However, the pump actuator 510 is omitted from the oral care implement 3 of FIG. 12 and the cavity 400 is of variable, rather than fixed, volume. More specifically, in the oral care implement 3 of FIG. 12, the handle 110 defines the cavity 400, is resilient (i.e. is made of a resilient material(s)), and is compressible to reduce the volume of the cavity 400.

In order to operate the toothbrush 3 of FIG. 12, while maintaining the control valve 600 at the first position, and preferably prior to brushing their teeth, a user applies a force to the handle 110 to squeeze or compress the handle 110 in their hand, thereby to reduce the volume of the cavity 400. More specifically, the compression of the handle 110 causes a reduction in the volume of the second reservoir 402. Since the first check valve 511 prevents air leaving the second reservoir 402 via the first opening 420, such reduction in the volume of the second reservoir 402 increases the pressure of the air present in the second reservoir 402. The increased pressure of the air in the second reservoir 402 causes the air in the second reservoir 402 to apply a force to the vessel 411. This application of force to the vessel 411 causes the volume of the first reservoir 401 to be reduced, which pushes the oral care fluid in the first reservoir 401 towards the control valve 600. When the user subsequently reduces or removes the force applied to the handle 110, the inherent resiliency of the material of the handle 110 causes the handle to expand towards its original, uncompressed state, during which the first check valve 511 permits air to enter the second reservoir 402 via the first opening 420. Repeated such compressions and subsequent relaxations of the handle 110 while the control valve 600 is at the first position further increases the pressure of the oral care fluid in the first reservoir 401. That is, the oral care fluid in the first reservoir 401 becomes "pre-pressurized".

Preferably, the user next applies a dentifrice to the oral care elements 200 and then uses the dentifrice and the oral care elements 200 to brush their teeth. As for the embodiment of FIGS. 1 to 4, during the brushing, a force applied to the deformable member 610 of the control valve 600 by a surface in the user's oral cavity, such as their teeth or tongue, causes flexing, and thus deflection, of the deformable member 610 relative to the head 120 so that part of the flange 616 moves away from the front side 123 of the head 120 to place the passageway 330 in fluid communication with the exterior of the toothbrush 1. Such a force thus moves the control valve 600 to the second position for permitting fluid flow from the cavity 400, and more specifically from the first reservoir 401, through the fluid outlet 125 between the deformable member 610 and the wall of the head 120 defining the fluid outlet 125. Since the oral care fluid in the first reservoir 401 has been pre-pressurized, when the control valve 600 is moved to the second position, an appreciable volume of the oral care fluid flows out of the toothbrush 1 through the fluid outlet 125 via the passageway 330. The user may then remove or reduce the force applied to the deformable member 610, to permit the flange 616 to move back into full contact with the front side 123 of the head 120 to block the fluid outlet 125, thereby to return the control valve 600 to the first position. Of course, a user may choose to dispense the oral care fluid before, during or after brushing their teeth.

Figure 13:
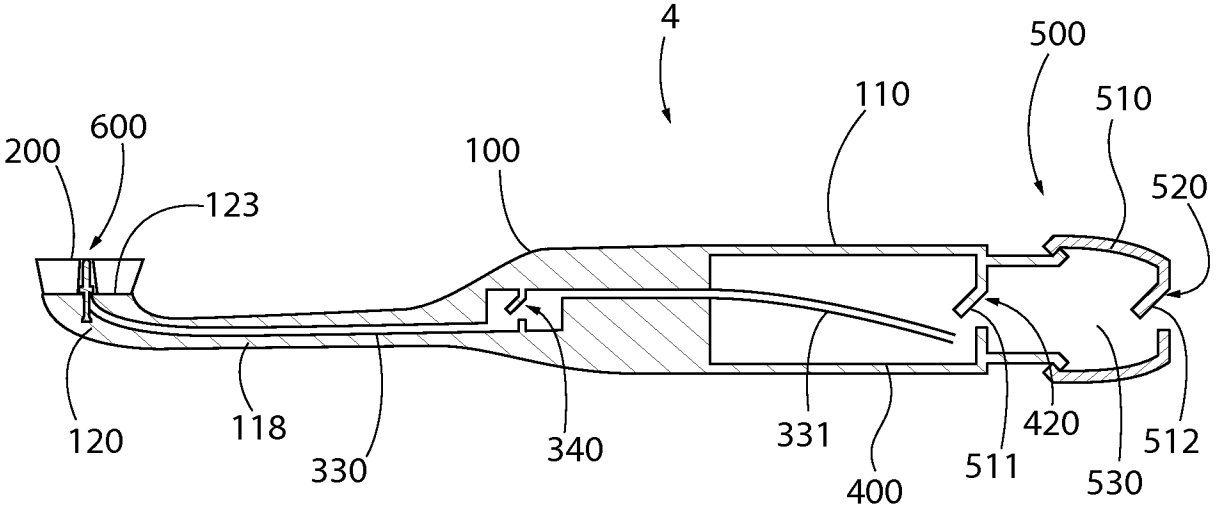
FIG. 13 shows a schematic diagram of an oral care implement according to another exemplary embodiment of the present invention.

In respective variations to the embodiments illustrated in FIGS. 1 to 11, the cavity 400 may be free of the piston 410, vessel 411 or any other movable wall that divides the cavity 400 into first and second reservoirs of variable volume. In those respective variations, the oral care fluid is stored in the cavity 400 and the oral care implement has a mechanism for introducing air into the cavity 400 from the exterior of the oral care implement. That is, the introduced air shares the same space as the oral care fluid and may become mixed therewith. In such respective variations, the passageway 330 may comprise a dip tube extending into the cavity 400 with an orifice in the cavity 400. An example such embodiment is shown in FIG. 13. Like reference numerals used in FIG. 13 and FIG. 2 indicate like components. The oral care implement 4 of FIG. 13 shares many features with the oral care implement 1 of FIGS. 1 to 4, and differs only in that the piston 410 in the cavity 400 is omitted and the passageway 330 includes a dip tube 331 that extends into the cavity 400 with an orifice in the cavity 400. The exterior of the oral care implement 4 of FIG. 13 is the same as that shown in FIG. 1.

Figure 14:
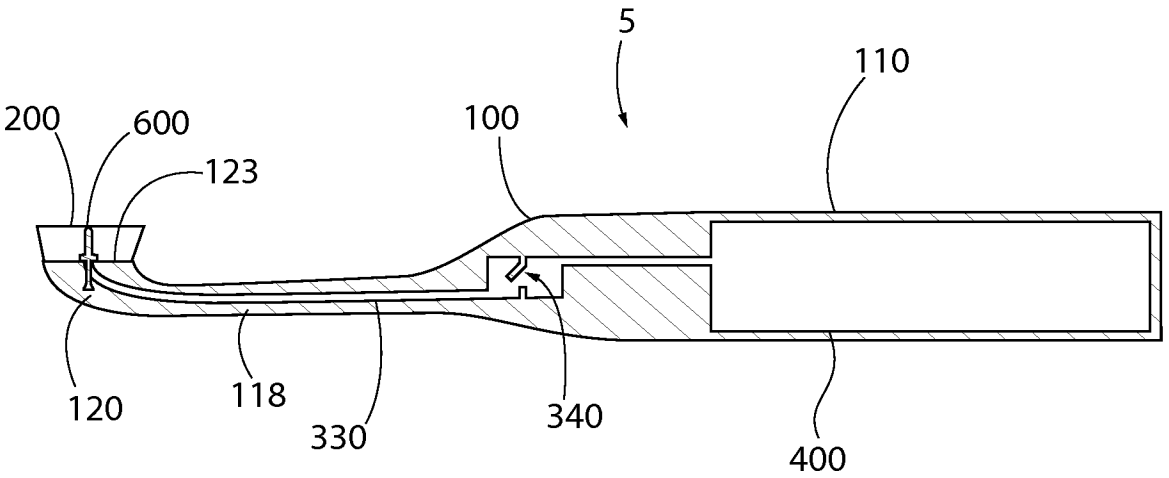
FIG. 14 shows a schematic diagram of an oral care implement according to a further exemplary embodiment of the present invention.

FIG. 14 illustrates an oral care implement, in this case a toothbrush, according to a further exemplary embodiment of the present invention, generally designated with the reference numeral 5. Like reference numerals used in FIG. 14 and FIG. 12 indicate like components. The oral care implement 5 of FIG. 14 shares many features with the oral care implement 3 of FIG. 12. However, the cavity 400 of the oral care implement 5 of FIG. 14 is of fixed, rather than variable, volume, the bellows 411 in the cavity 400 is omitted, and preferably the handle 110 is rigid, non-resilient and non-compressible. Moreover, the oral care fluid is stored in the cavity 400 at greater than atmospheric pressure with a propellant. By "atmospheric pressure", it is meant 101 kPa. That is, the oral care fluid in the cavity 400 is "pre-pressurized". In a variation to the illustrated embodiment, the passageway 330 includes a dip tube that extends into the cavity 400 with an orifice in the cavity 400, similar to the dip tube 331 of FIG. 13.

Preferably, the propellant comprises a liquefied gas, such as a liquefied gas comprising one or more of propane, butane, isobutene, dimethyl ether, and a hydroflurocarbon, or a mixture of any two or more thereof. However, in some embodiments, the propellant comprises a compressed gas, such as a compressed gas comprising one or more of nitrogen, carbon dioxide, nitrous oxide, and compressed air, or a mixture of any two or more thereof. The use of liquefied gas is preferred due to the ability of liquefied gases to produce consistent pressure during discharge of the contents of the cavity 400. As will be understood by the person skilled in the art, preferably the propellant is a fluid that boils at a temperature lower than a temperature at which the oral care fluid boils. Preferably, the propellant is a fluid that boils at a temperature well below room temperature (e.g. 21° C.).

In order to operate the toothbrush 5 of FIG. 14, while maintaining the control valve 600 at the first position, a user applies a dentifrice to the oral care elements 200 and then uses the dentifrice and the oral care elements 200 to brush their teeth. As for the embodiment of FIGS. 1 to 4, during the brushing, a force applied to the deformable member 610 of the control valve 600 by a surface in the user's oral cavity, such as their teeth or tongue, causes flexing, and thus deflection, of the deformable member 610 relative to the head 120 so that part of the flange 616 moves away from the front side 123 of the head 120 to place the passageway 330 in fluid communication with the exterior of the toothbrush 1. Such a force thus moves the control valve 600 to the second position for permitting fluid flow from the cavity 400 through the fluid outlet 125 between the deformable member 610 and the wall of the head 120 defining the fluid outlet 125. Once the cavity 400 is thus in fluid communication with the exterior of the toothbrush 5 via the fluid outlet 125, the pressure on the propellant in the cavity 400 is reduced. Accordingly, the propellant expands or begins to boil to create gas in the cavity 400, which gas pushes the oral care fluid through the passageway 330 and through the fluid outlet 125 to the exterior of the toothbrush 5 and into the user's oral cavity. Thus, when the control valve 600 is moved to the second position, an appreciable volume of the oral care fluid flows out of the toothbrush 5 through the fluid outlet 125 via the passageway 330. The user may then remove or reduce the force applied to the deformable member 610, to permit the flange 616 to move back into full contact with the front side 123 of the head 120 to block the fluid outlet 125, thereby to return the control valve 600 to the first position. Again, a user may choose to dispense the oral care fluid before, during or after brushing their teeth.

In respective variations to the toothbrushes 2, 3, 4, 5 of FIGS. 11 to 14, in place of the control valve 600 shown in FIGS. 3 and 4, the toothbrushes 2, 3, 4, 5 could have the control valve shown in FIGS. 5 and 6, the control valve shown in FIGS. 7 and 8, or the control valve shown in FIGS. 9 and 10.

In respective variations to the illustrated and discussed embodiments, the third check valve 340 is omitted.

In respective variations to the illustrated and discussed embodiments, the cavity 400 may be provided elsewhere in the body 100 than at the position shown in the Figures. For example, the cavity 400 may be provided in or adjacent to the neck portion 118 of the handle 110, or in the head 120 of the body 100. In some variations to the illustrated embodiment, the cavity 400 may extend into both the handle 110 and the head 120 of the body 100.

In respective variations to the embodiments illustrated in FIGS. 1 to 11, and 13, the second check valve 512 is omitted. In such variations, the pump 500 still is operable to reduce the volume of the chamber 530 when the second opening 520 is blocked by a user's finger or thumb, thereby to push air from the chamber 530 into the cavity 400 via the first opening 420.

In respective variations to the embodiments illustrated in FIGS. 1 to 11, and 13, the pump 500 may be provided elsewhere in the toothbrushes 1, 2, 4, 5 than at the position shown in the Figures. For example, the pump 500 may be provided in the head 120 of the body 100, in or adjacent to the neck portion 118 of the handle 110, or in or adjacent the thumb grip surface 311. For example, the thumb grip surface 311 could be a pump actuator, and the pump 500 could be actuated by a user moving the thumb grip surface 311 relative to the body 100, such as towards and away from the longitudinal axis A-A of the toothbrush.

In each of the illustrated and discussed embodiments, since the user need only brush their teeth in the usual manner in order, effectively passively, to cause dispensing of an appreciable volume of oral care fluid, the mechanism provided for dispensing the oral care fluid is convenient, and further is non-tiring and comfortable for the user to operate during dispensing.

What is claimed is:

1. An oral care implement, comprising:

a body comprising a handle and a head at an end of the handle;

the body having a cavity therein for storing an oral care fluid;

the head having at least one oral care element extending therefrom, and a fluid outlet through which the oral care fluid is dispensable to an exterior of the oral care implement;

a passageway fluidly connecting the cavity with the fluid outlet;

a mechanism for introducing air into the cavity from the exterior of the oral care implement; and a control valve on the head movable relative to the head between a first position for preventing fluid flow from the cavity through the fluid outlet and a second position for permitting fluid flow from the cavity through the fluid outlet;

wherein the oral care fluid is pre-pressurized, causing the oral care fluid to flow out of the oral care implement when the control valve is moved to the second position;

wherein the control valve comprises a deformable member and a flange extending around at least a portion of a perimeter or circumference of the deformable member, the flange blocking the fluid outlet when the control valve is at the first position.

2. The oral care implement of claim 1, comprising a movable wall in the cavity, the wall dividing the cavity into first and second reservoirs of variable volume, wherein the first reservoir is for storing the oral care fluid, and wherein the passageway fluidly connects the first reservoir with the fluid outlet.

3. The oral care implement of claim 2, wherein the body further defines a first opening fluidly connecting the second reservoir with the exterior of the oral care implement, and further comprising a first check valve for permitting air flow into the second reservoir from the exterior of the oral care implement via the first opening and for restricting air flow from the second reservoir to the exterior of the oral care implement via the first opening.

4. The oral care implement of claim 2, wherein the wall comprises a deformable vessel surrounding the first reservoir, and wherein the vessel has an orifice in fluid communication with the passageway.

5. The oral care implement of claim 4, wherein at least a portion of the second reservoir surrounds the first reservoir.

6. The oral care implement of claim 3, comprising a pump comprising a chamber and a second opening fluidly connecting the chamber with the exterior of the oral care implement, wherein the chamber is fluidly connected with the second reservoir via the first opening.

7. The oral care implement of claim 6, wherein the chamber is of variable volume, and the pump is operable to reduce the volume of the chamber when the second opening is blocked, thereby to push air from the chamber into the second reservoir via the first opening.

8. The oral care implement of claim 6, wherein the pump comprises a second check valve for permitting air flow into the chamber from the exterior of the oral care implement via the second opening and for restricting air flow from the chamber to the exterior of the oral care implement via the second opening.

9. The oral care implement of claim 1, wherein the passageway comprises a dip tube in the cavity.

10. The oral care implement of claim 1, wherein, when the control valve is at the first position, the control valve blocks the fluid outlet or the passageway.

11. The oral care implement of claim 1, wherein the head has at least one wall defining the fluid outlet, and wherein the deformable member extends through the fluid outlet, wherein the control valve is movable relative to the head between a first position for preventing fluid flow through the fluid outlet and a second position for permitting fluid flow through the fluid outlet between the deformable member and the wall.

12. An oral care implement, comprising:

a body comprising a handle and a head at an end of the handle;

the body having a cavity therein for storing an oral care fluid;

the head having at least one oral care element extending therefrom, and at least one wall defining a fluid outlet through which the oral care fluid is dispensable to an exterior of the oral care implement;

a passageway fluidly connecting the cavity with the fluid outlet; and a control valve comprising a deformable member extending through the fluid outlet, wherein the control valve is movable relative to the head between a first position for preventing fluid flow through the fluid outlet and a second position for permitting fluid flow through the fluid outlet between the deformable member and the wall;

wherein the control valve comprises a flange extending around at least a portion of a perimeter or circumference of the deformable member, the flange blocking the fluid outlet when the control valve is at the first position.

13. The oral care implement of claim 12, wherein the flange is in contact with a side of the head in which the fluid outlet is formed when the control valve is at the first position.

14. The oral care implement of claim 12, wherein the deformable member comprises a tooth cleaning or polishing element.

15. An oral care implement, comprising:

a body comprising a handle and a first head at an end of the handle;

the body having a cavity therein for storing an oral care fluid;

the first head having at least one oral care element extending therefrom, and a fluid outlet through which the oral care fluid is dispensable to an exterior of the oral care implement;

a passageway fluidly connecting the cavity with the fluid outlet; and a control valve comprising a second head movably connected to the first head and having at least one oral care element extending therefrom, wherein the second head is movable relative to the first head between a first position for preventing fluid flow through the fluid outlet and a second position for permitting fluid flow through the fluid outlet;

wherein the oral care elements extend from respective first sides of the first and second heads, and the oral care implement comprises a flexible pad connecting respective second sides of the first and second heads, wherein the second sides of the heads are opposite from the first sides of the heads.

16. The oral care implement of claim 15, wherein the flexible pad is comprised in a soft tissue cleaner of the oral care implement, the soft tissue cleaner comprising one or more projections extending from the flexible pad.

* * * * *